US005823835A

United States Patent [19]

Takahashi et al.

[11] Patent Number: 5,823,835

[45] Date of Patent: Oct. 20, 1998

[54] OUTBOARD MOTOR THROTTLE CONTROL

[75] Inventors: Masanori Takahashi; Hiroshi Oishi; Hitoshi Watanabe, all of Hamamatsu, Japan

[73] Assignee: Sanshin Kogyo Kabushiki Kaisha, Shizuoka-ken, Japan

[21] Appl. No.: 819,595

[22] Filed: Mar. 17, 1997

[30] Foreign Application Priority Data

Mar. 18, 1996 [JP] Japan ..... 8-088760

[51] Int. Cl.[6] ..... B63H 20/00

[52] U.S. Cl. ..... 440/2; 440/87; 440/88; 440/89

[58] Field of Search ..... 440/2, 88, 84, 440/86, 87, 89, 77

[56] References Cited

U.S. PATENT DOCUMENTS

| | | | |
|---|---|---|---|
| 2,460,419 | 2/1949 | Kincannon | 440/89 |
| 2,743,624 | 5/1956 | Schroeder | 440/86 |
| 3,933,114 | 1/1976 | Horn | 440/88 |
| 4,767,363 | 8/1988 | Uchida et al. | 440/84 |
| 4,925,416 | 5/1990 | Oishi | 440/87 |
| 5,061,214 | 10/1991 | Monaghan | 440/88 |
| 5,080,617 | 1/1992 | Broughton | 440/88 |
| 5,118,316 | 6/1992 | Kakizaki | 440/89 |
| 5,380,228 | 1/1995 | Kawai et al. | 440/88 |
| 5,476,402 | 12/1995 | Nakai et al. | 440/88 |

*Primary Examiner*—Sherman Basinger
*Attorney, Agent, or Firm*—Knobbe, Martens, Olson & Bear, LLP

[57] ABSTRACT

In accordance with the present invention there is provided an outboard motor for use in powering a watercraft of the type having an operator station positioned along a starboard side of the watercraft. The motor has a water propulsion device powered by an engine having an exhaust system generally positioned along a right side thereof. A cooling system is provided for cooling the engine and the exhaust system. Preferably, the motor includes a cooling water tell-tale acting as a visual identifier to the operator of the craft that the cooling system for the engine is operating. The tell-tale is created by diverting coolant from a portion of the cooling system for cooling the exhaust system to a pilot port in the side of the cowling corresponding to the starboard side of the watercraft. In addition, the motor preferably includes a throttle control and shift control which extend along the right side of the engine through the cowling to the operator station in the watercraft. The throttle control is connected via a linkage extending to the opposite side of the engine to an intake throttle, while the shift control is connected via a linkage to a transmission control.

15 Claims, 8 Drawing Sheets

OUTBOARD MOTOR THROTTLE CONTROL

FIELD OF THE INVENTION

The present invention relates to an outboard motor of the type utilized to power a watercraft. More particularly, the invention is an outboard motor including a throttle control for controlling the speed of an engine thereof remotely from the watercraft, and where the engine includes a cooling water tell-tale positioned for viewing by the operator controlling the throttle.

BACKGROUND OF THE INVENTION

Outboard motors powered by internal combustion engines are commonly provided with cooling water tell-tales. The tell-tale is, in essence, a visual indicator in the form of a water spout. The spout indicates to the operator of the watercraft that the cooling system for the engine is operating. The tell-tale is typically formed by diverting a small amount of cooling water from one of the cooling passages of the engine to a discharge port through the cowling of the motor.

When the engine is running and coolant is being supplied to the cooling system, a small amount of the coolant is diverted to the discharge port where it sprays outward from the motor. In this manner, the operator of the watercraft which is being powered by the outboard motor is given a visual indication that coolant is properly being supplied to the engine.

For the tell-tale to be an effective indicator, it must be visible. If the cooling water tell-tale is positioned on the side of the motor opposite the watercraft operator, the operator is prevented from viewing the tell-tale from his operator position without moving to the other side of the watercraft.

It is very common for the engine of the watercraft powering the motor to have the exhaust system positioned on a left side (i.e. a side corresponding to the port or left side of the watercraft when mounted thereto) and an intake system positioned on right side (i.e. a side corresponding to the starboard or right side of the watercraft when mounted thereto). To provide convenient access to the cooling system, a pilot line is provided to the pilot port from a coolant passage or jacket for cooling a portion of the exhaust system.

Most commonly, the operator station of a watercraft is on the starboard side. In the simplest arrangement, the pilot line extends from the cooling system for the exhaust system at the left side of the engine to the pilot port on the left side of the motor. In this position, however, the tell-tale is out of the view of the operator. To overcome the problem that the operator can not see the tell-tale, the pilot line must extend to the opposite side of the motor. This arrangement greatly complicates the engine, however.

A convenient arrangement for an engine for use in powering an outboard motor of a watercraft, wherein the motor has a cooling water tell-tale arranged for viewing by an operator controlling the throttle of the engine from a remote operator control station of the watercraft, is desired.

SUMMARY OF THE INVENTION

In accordance with the present invention, an outboard motor is provided for use in powering a watercraft. Preferably, the watercraft is of the type having an operator station positioned along a starboard side thereof. The operator station includes a throttle and a shift control for controlling the engine speed and transmission of the motor remotely from the watercraft.

Preferably, the outboard motor includes an internal combustion engine powering a water propulsion device. The engine is positioned within a motor cowling, and arranged such that a cooling water tell-tale is provided on the right side thereof, corresponding to the starboard side of the watercraft. Most preferably, the engine is arranged so that an exhaust system thereof is generally positioned on the right side, and an intake system is provided on the left. In this manner, the cooling water tell-tale may be provided by diverting a portion of the cooling water through a short pilot line extending from an exhaust cooling passage to the adjacent right side of the cowling through a pilot port.

Preferably, the throttle control comprises a cable extending from a lever positioned at the operator station in the watercraft to a linkage connection along the right side of the engine. The linkage extends to the opposite side of the engine to an intake throttle. Likewise, a shift control is provided for controlling the transmission of the motor. Preferably, the shift control comprises a cable extending from a lever or the like positioned at the operator station in the watercraft to a linkage positioned along the right side of the engine as well.

In the arrangement of the present invention, a watercraft operator positioned at the operator statement of the watercraft along the starboard side thereof may remotely control the throttle and transmission. At the same time, a cooling water tell-tale is visible to the operator.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor 20 having an engine with a throttle control and cooling water tell-tale in accordance with the present invention.

Figure 1:
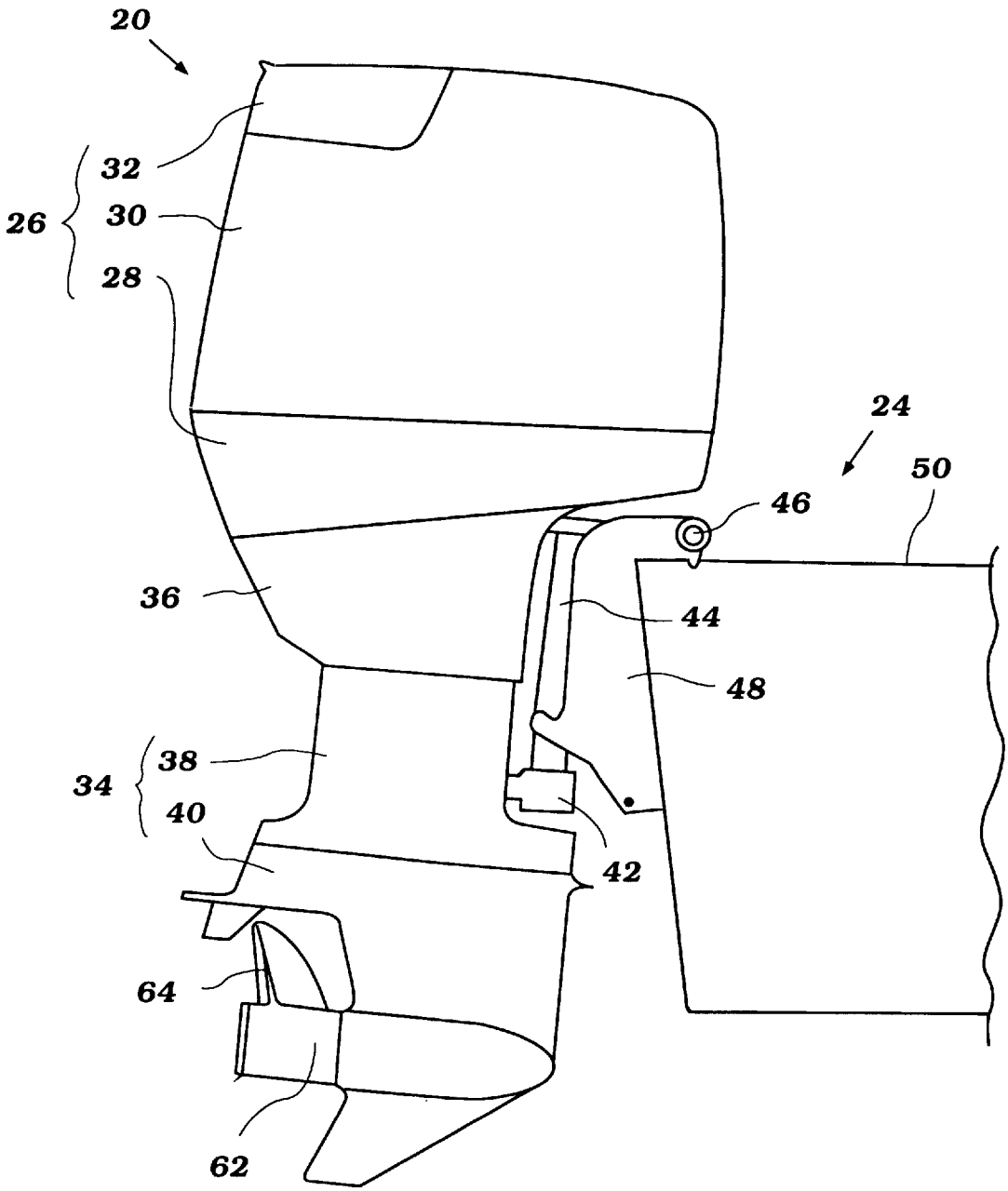
FIG. 1 is a side view of an outboard motor connected to a hull of a watercraft for powering the watercraft.

As best illustrated in FIG. 1, the outboard motor 20 is utilized to power a watercraft 24. The outboard motor 20 has a powerhead area 26 comprised of a lower tray portion 28 and a main cowling portion 30. An air inlet or vent 32 is provided in the main cowling portion 30 for providing air to an engine therein, as described in more detail below. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the lower section 40 of the lower unit 34 by means of a bracket 42. The steering shaft is supported for steering movement about a vertically extending axis within a swivel bracket 44. The swivel bracket 44 is connected by means of a pivot pin 46 to a clamping bracket 48 which is attached to a transom portion of a hull 50 of the watercraft. The pivot pin 46 permits the outboard motor 20 to be trimmed and tilted up about the horizontally disposed axis formed by the pivot pin 46.

Figure 2:
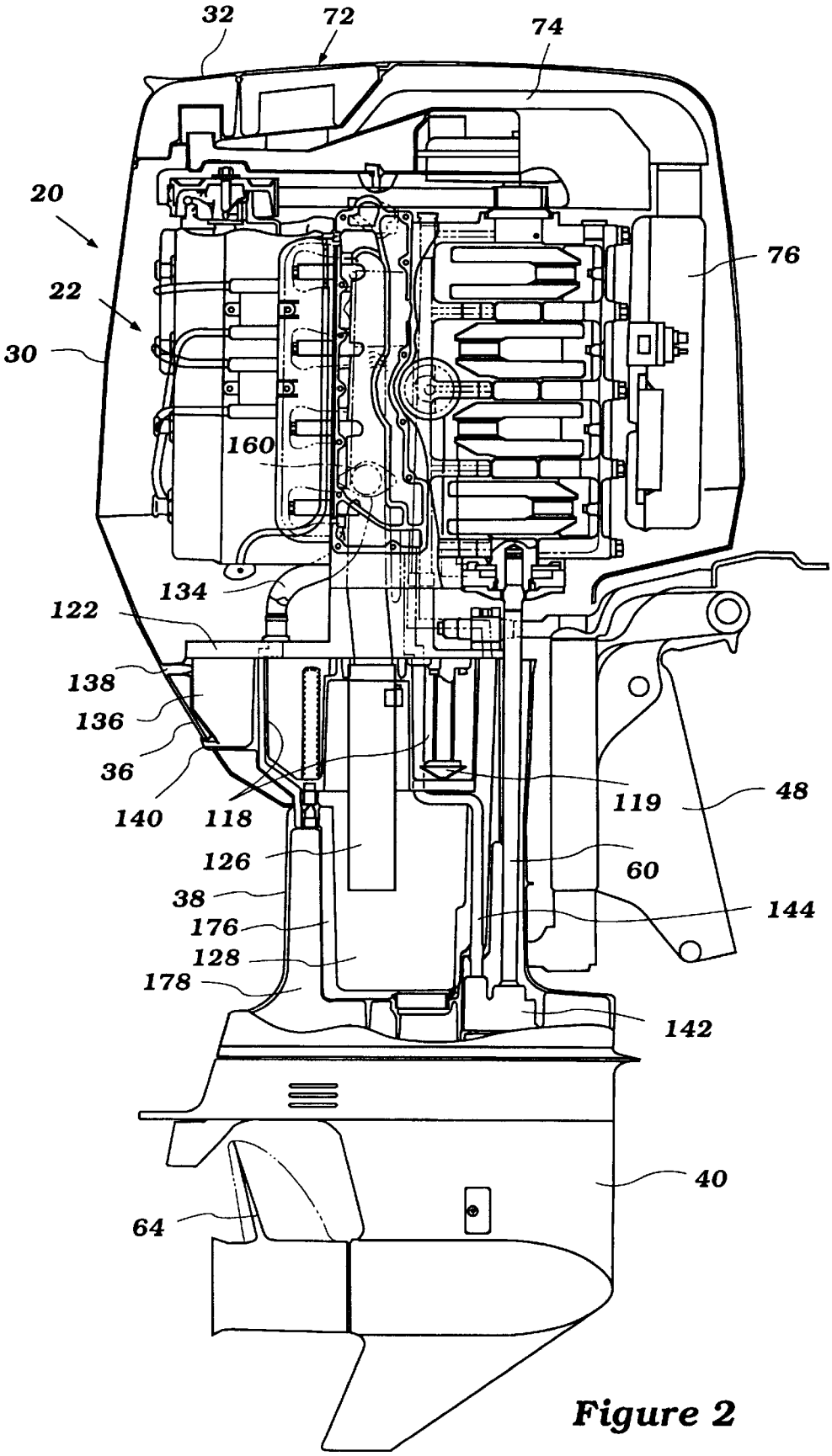
FIG. 2 is a side view, in partial cross-section, illustrating an internal combustion engine of the inline variety having an exhaust cooling arrangement in accordance with the present invention for use in powering the motor illustrated in FIG. 1.
Figure 3:
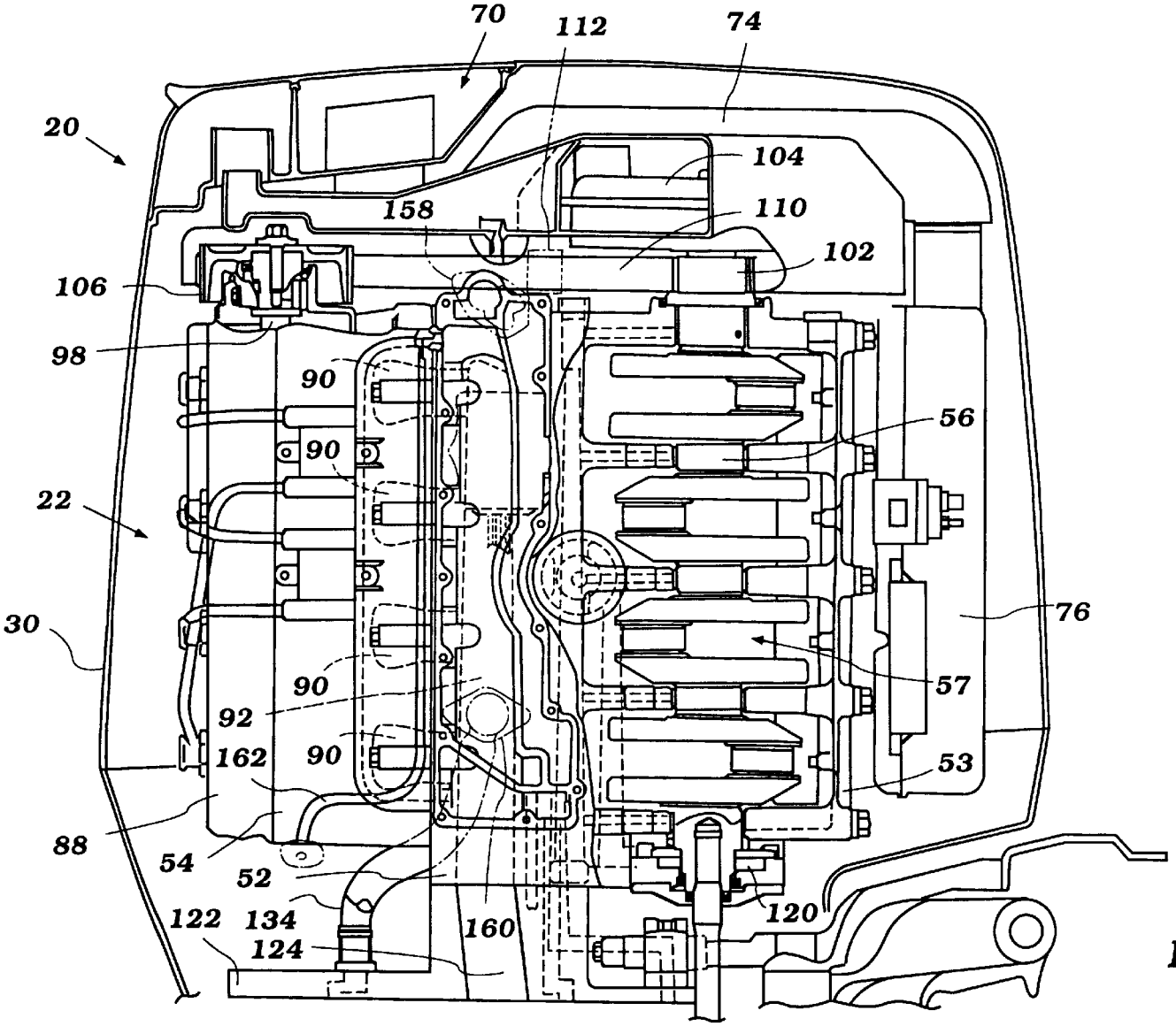
FIG. 3 is an enlarged view of a the engine illustrated in FIG. 2.

As best illustrated in FIGS. 2 and 3, the power head 26 of the outboard motor 20 includes the engine 22 which is positioned within the cowling portion 30. In the embodiment of the present invention illustrated in FIGS. 1–6, the engine 22 is preferably of the inline, four-cylinder, four-cycle variety, and thus includes a cylinder block 52 which has a cylinder bank closed by a cylinder head assembly 54 in a manner which will be described. As also illustrated in FIGS. 2 and 3, the engine 22 is preferably oriented within the cowling 30 such that its cylinder head 54 is positioned on the block 52 on the side opposite the watercraft's transom.

A crankshaft 56 is rotatably journalled in a crankcase chamber 57 formed by the cylinder block 52 and a crankcase cover 53. As is typical with outboard motor practice, the engine 22 is mounted in the power head 26 so that the crankshaft 56 rotates about a vertically extending axis. This facilitates coupling to a drive shaft 60 in a manner which will be described.

The drive shaft 60 depends into the lower unit 34, wherein it drives a bevel gear and a conventional forward-neutral-reverse transmission. The transmission is not illustrated herein, because its construction per se forms no part of the invention. Therefore, any known type of transmission may be employed. A control is provided, as disclosed in more detail, for allowing an operator to remotely control the transmission.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art.

Figure 6:
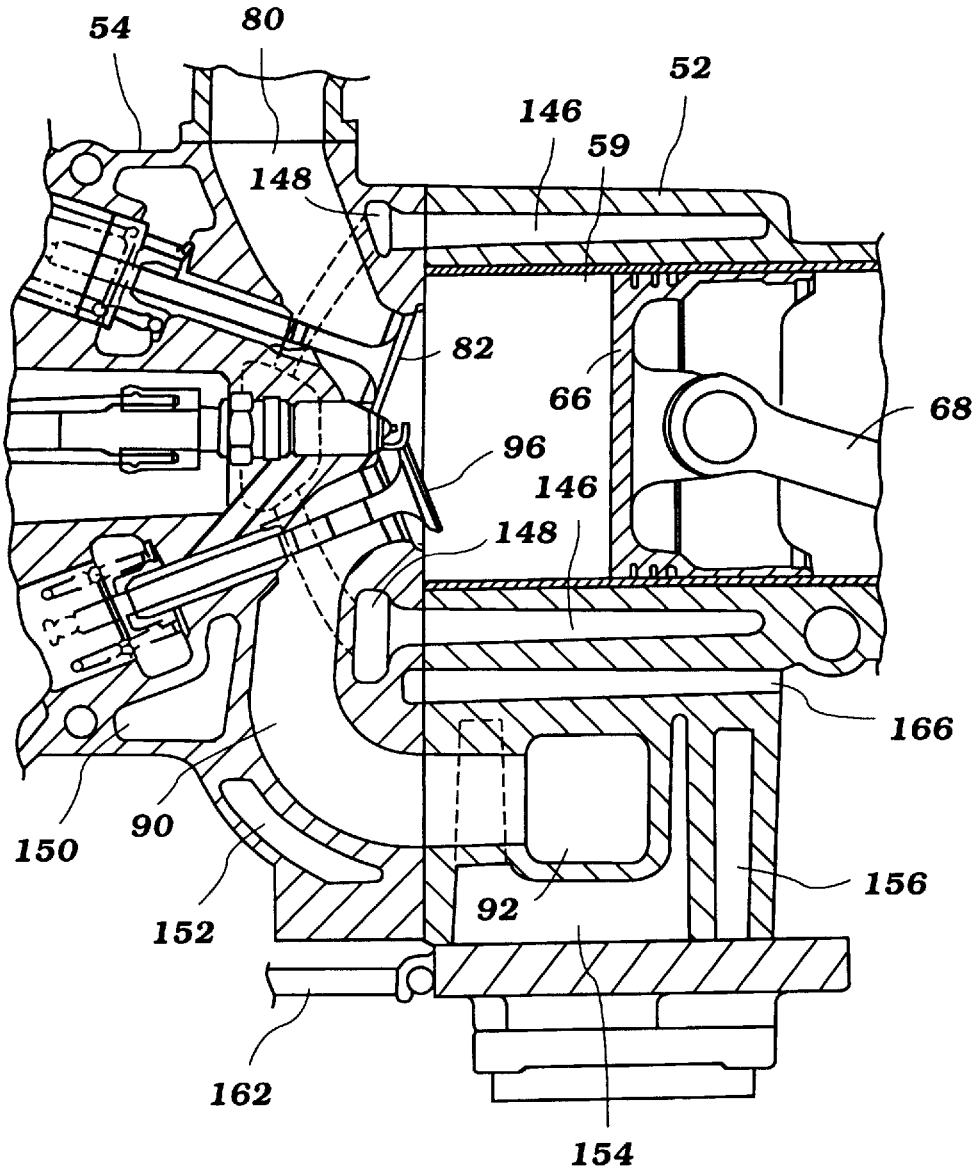
FIG. 6 is a partial cross-sectional view of the engine illustrated in FIG. 2, illustrating a combustion chamber thereof.

The construction of the engine 22 and the exhaust manifold cooling arrangement of the present invention will now be described in more detail. As illustrated in FIGS. 2, 3 and 6, the engine 22 has a number of variable volume combustion chambers 59, preferably totaling four in number, arranged in inline fashion. It should be understood that there may be as few a one combustion chamber, or more than four.

Each combustion chamber has a piston 66 mounted therein for reciprocation, the piston connected to the crankshaft 56 via a connecting rod 68. The cylinder head 54 is preferably connected to the cylinder block 52 via a number of bolts, as is known in the art.

As illustrated in FIGS. 2, 3, 5 and 6, an intake system 70 provides air to each combustion chamber. The intake system 70 includes an air intake 72 positioned adjacent the vent 32 in the cowling 30. As best illustrated in FIG. 2, air drawn through this intake 72 passes into an air passage formed between the cowling 30 and a camshaft drive cover 74 positioned on the top of the engine 22, to a surge tank 76. Air is routed from the surge tank 76 by a runner 78 to a passage 80 positioned within the cylinder head 54 leading to the combustion chamber. An inlet passage 80 is provided corresponding to each combustion chamber 59.

Means are provided for controlling the passage of air through each inlet passage 80 to its respective combustion chamber 59. Preferably, this means comprises an intake valve 82. As illustrated, all of the intake valves 82 are preferably actuated by an intake camshaft 84. The intake camshaft 84 is mounted for rotation with respect to the head 54 and connected thereto with at least one bracket 86. The camshaft 84 is enclosed by a camshaft cover 88 which is connected to the head 54.

An exhaust system is provided for routing the products of combustion within the combustion chambers 59 to a point external to the engine 22. In particular, an exhaust passage 90 leads from each combustion chamber to a passage 92 in an exhaust manifold portion 94 of the engine 22. The remainder of the exhaust system will be described in more detail below.

Means are also provided for controlling the flow of exhaust from each combustion chamber 59 to its respective exhaust passage 92. Preferably, this means comprises an exhaust valve 96. Like the intake valves 82, the exhaust valves 96 are preferably all actuated by an exhaust camshaft 98. The exhaust camshaft 98 is journalled for rotation with respect to the cylinder head 54 and connected thereto with at least one bracket 100. The exhaust camshaft 98 is enclosed within the camshaft cover 88.

Figure 5:
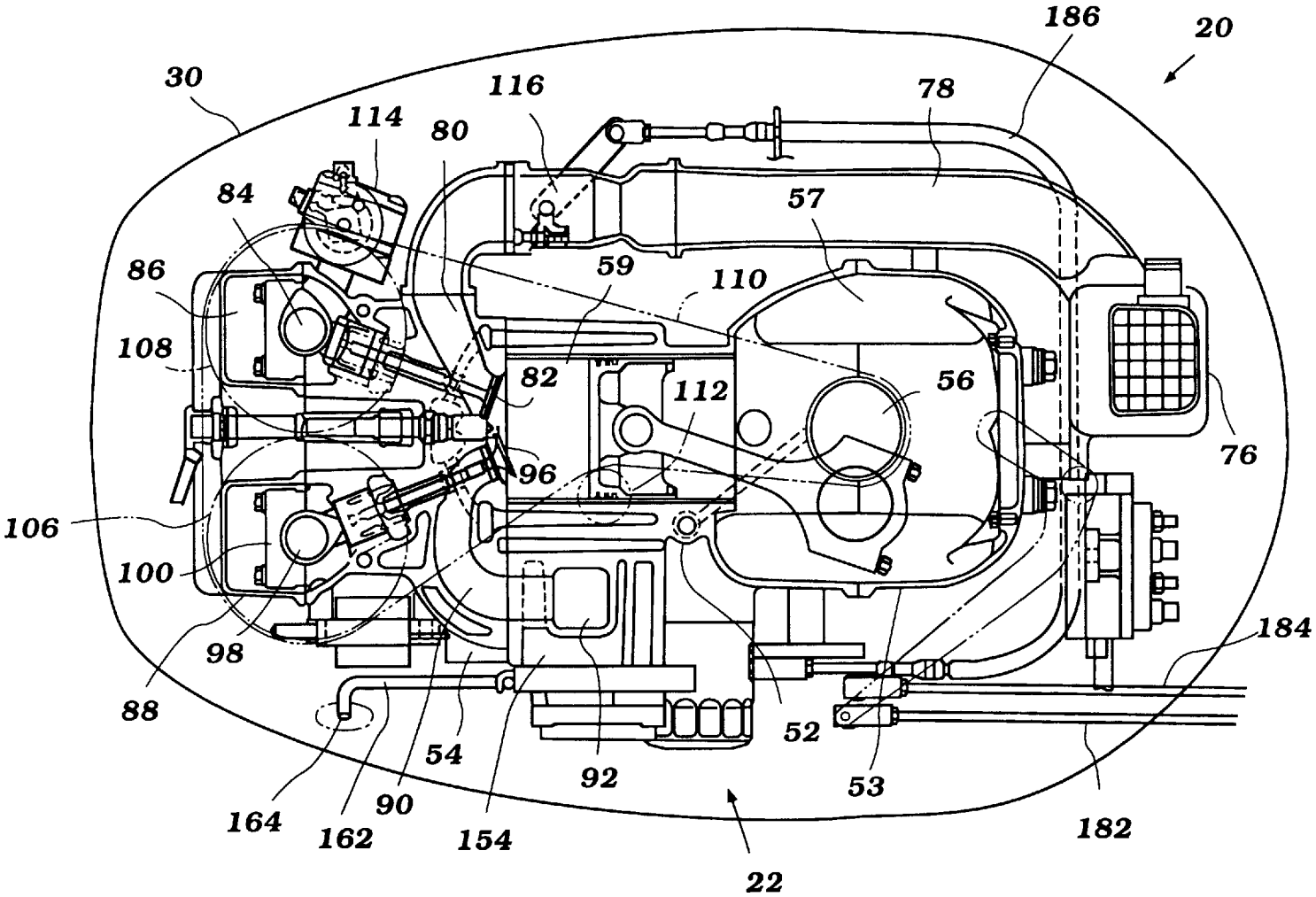
FIG. 5 is a top view of the engine illustrated in FIG. 2, the engine including a cooling water tell-tale and throttle control arrangement in accordance with a first embodiment of the present invention.

As best illustrated in FIGS. 3 and 5, means are provided for driving the camshafts 84,98. A timing belt pulley 102 is mounted on a top end of the crankshaft 56 positioned outside of the cylinder block 52, and just below a flywheel 104 also positioned on the crankshaft 56. An exhaust camshaft pulley 106 is mounted on an end of the exhaust camshaft 98 extending from the top end of the engine 22, and an intake camshaft pulley 108 is mounted on an end of the intake camshaft 84 extending from the top end of the engine. A drive belt 110 extends around the timing belt pulley 102 and the exhaust and intake camshaft pulleys 106,108, whereby the camshaft 56 indirectly drives the camshafts 84,98. One or more tensioner pulleys 112 may be provided for maintaining the belt in a taunt condition.

A fuel delivery system is provided for delivering fuel to each combustion chamber 59 for combustion therein. The fuel delivery system preferably includes a fuel tank (not shown) and a fuel pump 114 for pumping fuel from the tank and delivering it to each combustion chamber 59. As known to those skilled in the art, the fuel may be delivered into the incoming air stream, such as with a carburetor or fuel injector, or directly injected into the combustion chamber with a fuel injector.

A throttle 116 is provided for controlling the flow of air into each combustion chamber 59. Preferably, the throttle 116 comprises a moveable plate positioned within the runner 78. The throttle 116 is preferably controlled through a throttle control by the operator of the watercraft 24, as described in more detail below.

A suitable ignition system is provided for igniting an air and fuel mixture within each combustion chamber 59. Such systems are well known to those skilled in the art, and as such forms no portion of the invention herein, such is not described in detail here.

The engine 22 includes a lubricating system for providing lubricant to the various portions of the engine. The lubricating system is not described in detail here, and may be of a variety of types found suitable to those skilled in the art. Generally, the lubricating system includes an oil reservoir 118 positioned below the engine 22. The reservoir 118 is defined by a wall 117 and is in communication with an oil pump 120 via a suction tube 119. The oil pump 120 is preferably positioned on the end of the crankshaft 56 at the bottom of the engine 22. The oil pump 120 pumps lubricant from the reservoir 118 through oil passages throughout the engine 22. The pumped oil drains from the engine 22 back to the reservoir 118 for recirculation by the pump 120.

As illustrated in more detail in FIG. 6, the exhaust manifold is preferably formed integrally with the cylinder block 52. In this arrangement, the exhaust passage 92 is simply a passage extending generally vertically through an extended portion of the cylinder block 52.

Figure 4:
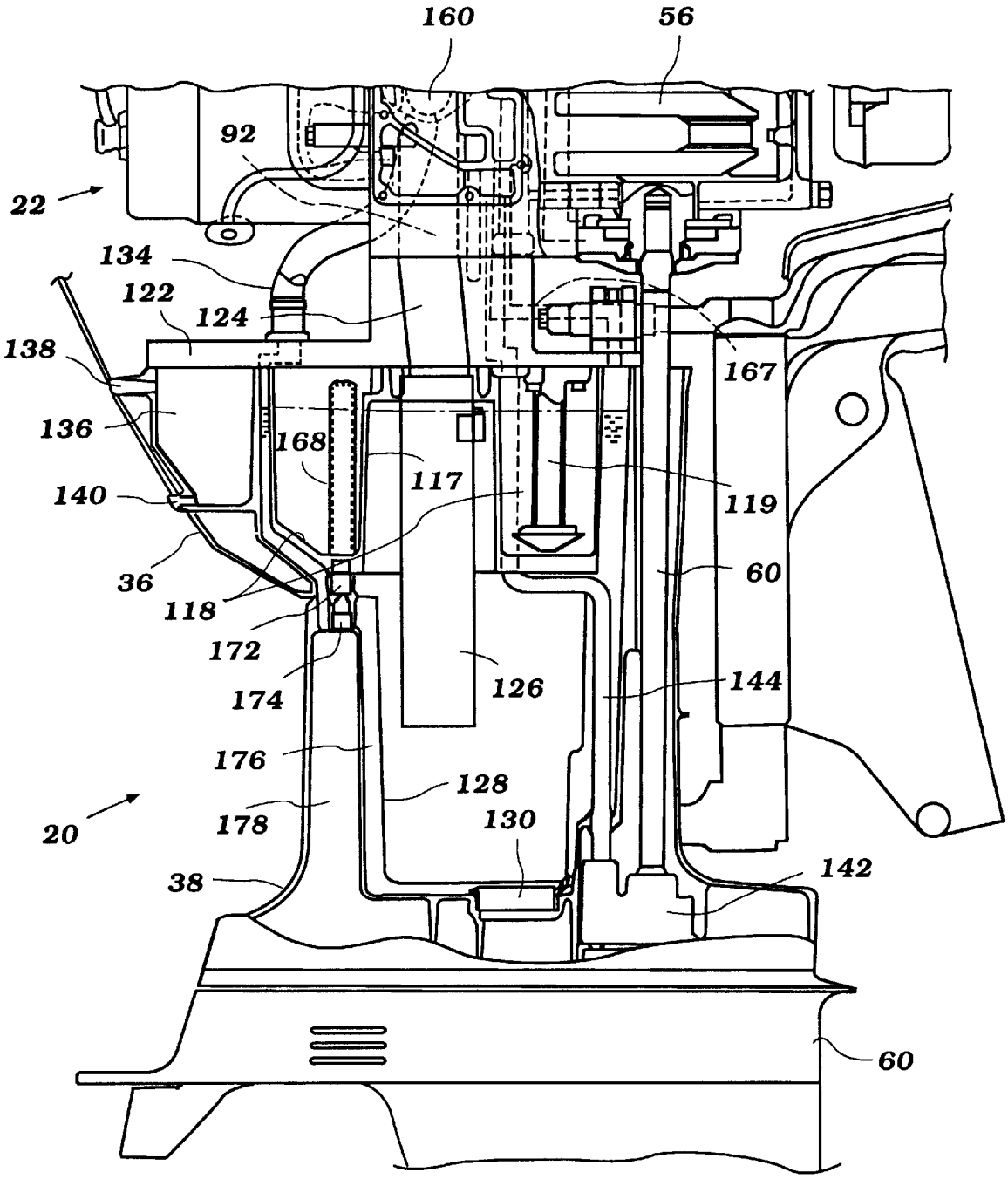
FIG. 4 is an enlarged view of a lower portion of the engine illustrated in FIG. 2 and motor components related thereto.

As best illustrated in FIG. 4, an exhaust guide 122 is positioned at the bottom end of the engine 22. The exhaust guide 122 has a passage 124 extending therethrough which is aligned with the passage 92 at its top side. An exhaust pipe 126 is connected to the bottom side of the exhaust guide 122 in alignment with the passage 124. The exhaust pipe 126 terminates within a chamber formed within a muffler 128.

The muffler 128 is positioned within the lower unit 38 and between the drive shaft 60 and a cooling liquid return. An exhaust gas outlet 130 is provided in the bottom end of the muffler 128, through which the exhaust gas is routed to a point external of the motor 20, normally through a passage extending through the hub 62 of the propeller 64.

When the exhaust pressure is low, normally when the engine speed is low, the exhaust gas is diverted to an above-water exhaust gas discharge. In the embodiment illustrated in FIG. 2, this discharge comprises an expansion chamber 136 and first and second exhaust ports 138,140. The exhaust ports 138,140 extend through the apron 36 from the chamber 136 for exhausting gases therefrom. The lower exhaust port 140 is provided for use in allowing condensed liquids to drain from the chamber 136.

As illustrated in FIG. 6, a space 166 is provided between the common exhaust passage 92 and each combustion chamber 59 for reducing rate of heat transfer from exhaust gases flowing through the passage 92 to the combustion chambers 59. In the arrangement illustrated in FIG. 6, the space 166 is an elongate passage extending from the exterior of the cylinder block 52 inwardly therethrough to a mating portion in the cylinder head 54, are positioned within the block. Preferably, a space 166 is provided between the passage 92 and the cooling liquid jacket 146 surrounding each combustion chamber 59.

The engine 22 preferably includes a liquid cooling system. Cooling liquid, preferably cooling water from the body of water in which the motor 22 is positioned, is pumped by a pump 142 positioned in the lower unit 34. The pump 142 is preferably driven by the drive shaft 60, and expels the cooling liquid or water upwardly through a cooling liquid pipe 144. This cooling liquid passes into a number of cooling liquid passages throughout the cylinder block 52 and head 54. As best illustrated in FIGS. 4–6, these passages include a cooling liquid jacket 146 surrounding the combustion chambers 59 in communication with a similar cooling liquid jacket or passage 148 in the cylinder head 54. Cooling liquid passages 150,152 are further provided in the cylinder head 54 adjacent the exhaust valves 96 and exhaust passages 90. A cooling liquid passage 154 is preferably provided in the manifold portion 94 of the cylinder block 52 on a side of the exhaust passage 92 defined therein opposite the combustion chambers 59. All of the cooling liquid passages lead to a cooling liquid outlet passage 156. Preferably, the cooling liquid flows first through passage 154 and then passages 150,152, before flowing to the passages 146,148 surrounding the combustion chamber 59.

The cooling system preferably includes a thermostat 158 for controlling the flow of cooling liquid through the various cooling liquid passages. In particular, the thermostat 158 is arranged at the top end of the engine 22 for controlling the flow of cooling liquid through the engine 22 to the outlet passage 156. The thermostat 158 prevents the cooling liquid from flowing through the engine 22 when the temperature of the cooling liquid therein is below a pre-determined temperature, thereby allowing the engine to warm up.

In addition, a cooling liquid pressure relief valve 160 is provided. This valve 160 is preferably in communication with the cooling liquid passage 154, and has a relief line 134 extending therefrom. In the instance where the cooling liquid pressure within the cooling passages exceeds a pre-determined pressure, the pressure relief valve 160 opens, allowing cooling liquid to flow through the line 134 to a cooling liquid pool or chamber 176.

Cooling liquid which circulates through the engine 22 to the outlet passage 156 (when the thermostat 158 is open) passes downwardly through a cooling liquid discharge pipe 167 a chamber 176 which extends at least partially around the oil tank 118, muffler 28 and other components. An overflow pipe 168 has its top end positioned in the chamber 176, and extends to first and second passages 172,174 leading to a discharge tank 178, before passing out of the motor 20 back to the body of water from which it was drawn.

Figure 9:
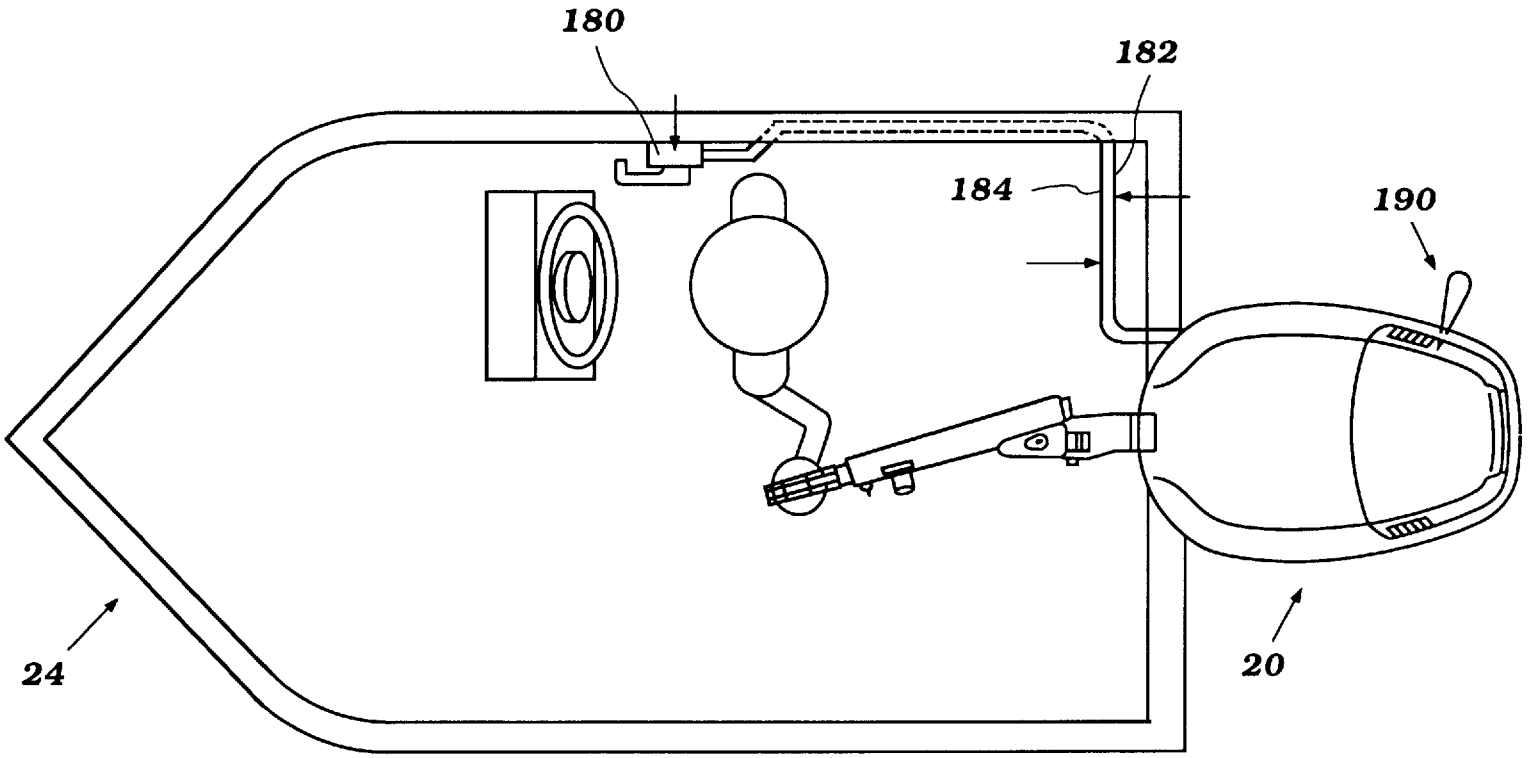
FIG. 9 is a top view of a watercraft having an outboard motor of the present invention connected thereto and including a throttle control and cooling water tell-tale in accordance therewith.

As best illustrated in FIGS. 5 and 9, the outboard motor 20 includes means for allowing the operator to control the throttle and the transmission of the motor 20 remotely from the watercraft. As best illustrated in FIG. 9, a control unit 180 is preferably provided at an operator station of the watercraft 24. The control unit 180 includes a lever or levers for controlling the throttle and shift position of the motor 20.

Preferably, a shift control cable 182 extends from the control unit 180 to a shift linkage within the cowling 30 of the outboard motor 20. This shift linkage is connected to the transmission, whereby the operator of the watercraft 24 may control the transmission, such as from forward to reverse, from the watercraft 24.

In addition, a throttle control cable 184 extends from the control unit 180 to a connection with a linkage 186 within the cowling 30 of the outboard motor 20. The linkage 186, which is preferably a cable, extends from the throttle control cable 184 to the throttle 116, whereby the operator of the watercraft 24 may control the speed of the engine 20 remotely from the watercraft 20. Notably, in the embodiment illustrated in FIG. 5, the linkage 186 extends around the end of the engine 22 nearest the watercraft 20.

Figure 7:
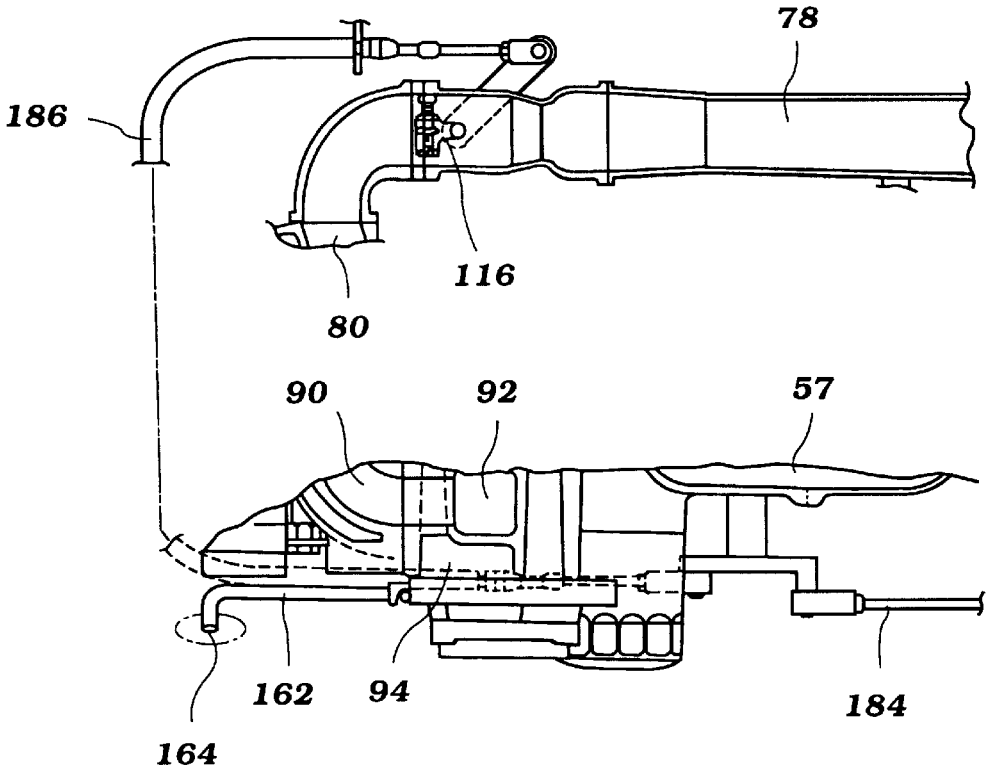
FIG. 7 illustrates a second embodiment arrangement for the throttle control of the engine.

As illustrated in an alternate embodiment in FIG. 7, the linkage cable 186 may extend along the right side of the engine 20 and then around the end of the engine opposite the watercraft 20 to the throttle 116.

Figure 8:
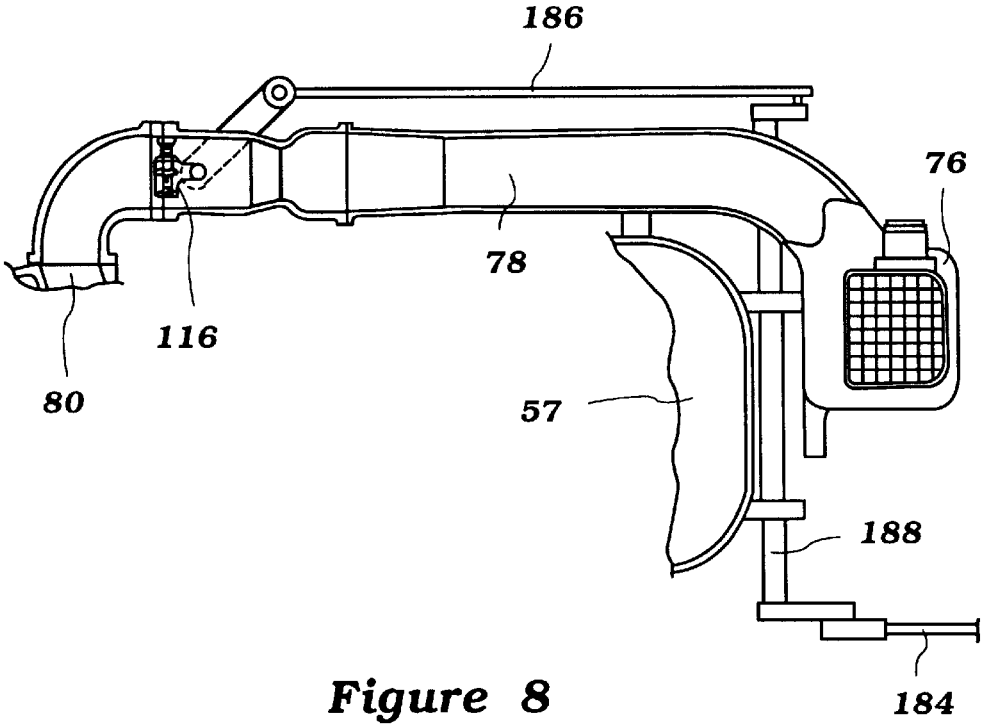
FIG. 8 illustrates a third embodiment arrangement for the throttle control of the engine.

Lastly, in yet another embodiment illustrated in FIG. 8, the linkage includes a rotatably mounted arm 188. The throttle control cable 184 extends to the rotatable arm 188, which extends generally laterally across the end of the engine 22 facing the watercraft 24. The linkage further includes a rod 186 extending from the end of the arm 188 to the throttle 116.

Most preferably, and for reasons discussed in more detail below, the throttle and shift cables 182,184 preferably extend from the watercraft 24 through the cowling 30 along the right side of the engine 22.

In accordance with the present invention, a cooling water tell-tale 190 (see FIG. 9) is provided, allowing the operator of the watercraft 24 to visually determine that coolant is being provided to the engine 22. Referring to FIG. 5, a pilot line 162 extends from one of the cooling liquid passages to a pilot port 164. The port 164 is positioned above the water line, such that a small amount of cooling liquid is expelled therefrom as a visual identifier to the operator that cooling liquid is being provided to the engine.

As illustrated in FIG. 9, since the control unit 180 is positioned along the starboard or right side of the watercraft 24, the operator is similarly positioned when operating the watercraft 24. In order that the operator may visually determine if the cooling system is working properly, the pilot line 162 extends from the cooling passage 156 corresponding to the main exhaust passage 92 along the right side (corresponding to the right or starboard side of the watercraft 24 when mounted thereto) to the port 164, which is provided in the right side of the cowling 30. In this manner, the cooling tell-tale 190 is provided on the side of the motor 20 corresponding to the starboard side of the watercraft 24, allowing the operator to easily view it.

Another advantage of the engine arrangement of the present invention is that the pilot line 162 need only extend from the cooling water passage 154 (on the right side of the engine 22) to the adjacent port 164 in the cowling 30 without extending to the opposite side of the motor 20.

Of course, the foregoing description is that of preferred embodiments of the invention, and various changes and modifications may be made without departing from the spirit and scope of the invention, as defined by the appended claims.

What is claimed is:

1. An outboard motor having a cowling with an internal combustion engine positioned therein, said engine having at least one variable volume combustion chamber with a member movably mounted therein, each member connected to a generally vertically extending crankshaft, said crankshaft in driving relation with a water propulsion device of said motor, said engine having an intake system for providing air to said at least one variable volume combustion chamber, and an exhaust system for routing exhaust generated in said at least one variable volume chamber from said engine, said exhaust system positioned generally on a side of said engine, said motor including a liquid cooling system for cooling said engine, including at least a portion of said exhaust system, said motor further including a pilot port positioned in a side of said cowling visible from an operator station of a watercraft which is to be powered by said motor, and adjacent said exhaust system and connected to a passage of said cooling system, whereby some coolant flowing through said cooling system is diverted therefrom to said pilot port and expelled therefrom outwardly of said cowling, thereby giving a visual indicator that the cooling system is working.

2. The outboard motor in accordance with claim 1, wherein said pilot port is connected via a pilot line to a cooling passage which cools a portion of said exhaust system.

3. The outboard motor in accordance with claim 2, wherein said exhaust system includes a main exhaust passage and said cooling system includes at least one passage for cooling said exhaust passage, and said pilot line extends from said passage.

4. The outboard motor in accordance with claim 3, wherein said engine comprises a cylinder block having a cylinder head connected thereto and said main exhaust passage and said at least one passage for cooling said exhaust passage are positioned in said cylinder block.

5. The outboard motor in accordance with claim 1, wherein motor further includes a throttle control for controlling the speed of said engine, said throttle control activated by a cable having a first end positioned along a right side of said engine, and connected to said throttle control via a linkage.

6. The outboard motor in accordance with claim 5, further including a shift control cable having a first end positioned adjacent said throttle cable.

7. The outboard motor in accordance with claim 1, wherein said water propulsion device comprises a propeller, said engine has a rear end facing in the direction of said water propulsion device and a front end facing opposite therefrom, and wherein said exhaust system is positioned along a right side of said engine when viewed in a direction facing the front end of said engine.

8. A watercraft having a hull and powered by an outboard motor connected to said hull, said watercraft having an operator station positioned proximate a starboard side of said watercraft, said motor positioned at a stern of said watercraft, said motor having a cowling housing an internal combustion engine, said engine having at least one variable volume combustion chamber with a member movably mounted therein and connected to a generally vertically extending crankshaft, said crankshaft in driving relation with a water propulsion device of said motor, an intake system for controlling the flow of air into said at least one combustion chamber, said intake system including a throttle, an exhaust system for routing exhaust gas generated in said at least one combustion chamber away from said engine, a cooling system for cooling said engine including at least a part of said exhaust system, and a pilot port positioned in a side of said cowling corresponding to said starboard side of said watercraft, said pilot port in fluid communication with said cooling system, and wherein said throttle is connected to an operator control at said operator station.

9. The watercraft in accordance with claim 8, further including a shift control for controlling a transmission controlling the movement of said water propulsion device.

10. The watercraft in accordance with claim 8, wherein said exhaust system is positioned on a right side of said motor and said pilot port is connected to a cooling system passage corresponding thereto.

11. The watercraft in accordance with claim 10, wherein said exhaust system includes an exhaust passage leading through a block portion of said engine from said combustion chamber, and wherein said cooling system includes a cooling passage in said block portion of said engine adjacent said cooling passage, and wherein a pilot line extends from said passage to said pilot port.

12. The watercraft in accordance with claim 8, wherein said throttle is controlled remotely from said operator station.

13. The watercraft in accordance with claim 12, wherein a throttle lever is positioned in said watercraft, a throttle cable extends from said lever to a point within said cowling generally adjacent a right side of said engine, where said cable is connected to a throttle linkage.

14. The watercraft in accordance with claim 13, wherein said throttle linkage comprises an arm mounted for rotation with respect to said cowling and extending to the opposite side of said engine, and wherein a rod extends therefrom to said throttle, wherein movement of said cable causes said arm to rotate, thereby causing said rod to move laterally, effectuating movement of said throttle.

15. The watercraft in accordance with claim 13, wherein said throttle linkage comprises a second cable extending about an end of said engine to said throttle, and wherein movement of said throttle cable causes movement of said second cable, thereby effectuating movement of said throttle.

* * * * *